United States Patent [19]

Farrow

[11] 4,061,085

[45] Dec. 6, 1977

[54] FLUID INJECTOR

[75] Inventor: Harold F. Farrow, Hitchin, England

[73] Assignee: Colorflo Limited, Hitchin, England

[21] Appl. No.: 702,492

[22] Filed: July 6, 1976

[51] Int. Cl.[2] ..... B41F 1/40

[52] U.S. Cl. ..... 101/150; 101/163; 101/366

[58] Field of Search ..... 101/366, 163, 170, 150, 101/151; 417/466, 467, 496, 469; 222/387, 253, 398, 379, 380; 118/50, 24

[56] References Cited

U.S. PATENT DOCUMENTS

| | | | |
|---|---|---|---|
| 2,779,059 | 1/1957 | Kruft | 101/150 |
| 3,543,682 | 12/1970 | Farrow | 101/163 X |
| 3,896,723 | 7/1975 | Farrow et al. | 101/150 |

FOREIGN PATENT DOCUMENTS

| | | | |
|---|---|---|---|
| 2,250,675 | 4/1973 | Germany | 101/163 |
| 2,411,188 | 9/1974 | Germany | 101/163 |

*Primary Examiner*—J. Reed Fisher

[57] ABSTRACT

A fluid injector unit, functioning as a pump-type injector unit through cooperation between an upper and lower press platen, being easily disassembled into a minimum number of parts for cleaning. Disengagement of a unitary assembly comprising a piston collar for supporting a main piston through biasing means therefor from a housing member containing a pump chamber results in easy access to those parts requiring cleaning without disassembly of parts external to fluid passages which do not require cleaning.

7 Claims, 3 Drawing Figures

FLUID INJECTOR

BACKGROUND OF INVENTION

The present invention relates to apparatus for depositing fluids, such as printing ink, paint, or sealant onto a substrate in a predetermined pattern or design, and particularly relates to fluid injectors for pumping fluid through the thickness of a die plate into a recessed design, the fluid injector being constructed for easy access to those parts requiring cleaning without disassembly of a multitude of other parts.

In the type of apparatus such as intaglio printing apparatus to which the present invention relates, the injector units are located between a die construction having an engraved die plate or a part thereof and one of two cooperating press platens so that when the press platens are moved toward each other to effect the deposition of a fluid, the fluid injector units are contracted to pump fluid into recesses in the engraved die plate. The platens are moved toward each other to engage the die plate with a substrate onto which the fluid is to be deposited and to effect a contraction of the fluid injector units to pump fluid through the die plate into the recessed design on the lower surface of the die plate.

Two such fluid injectors are disclosed in U.S. Pat. Nos. 3,896,722 and 3,896,723. Of course, these and other fluid injector units must be thoroughly cleaned after usage if the fluid injectors are to be used with another fluid. Such cleaning requires disassembly of the fluid injector units into a multitude of parts not only because of the numerous parts which come in contact with the fluid to be deposited but also because of the particular arrangement of the fluid injector units. Such disassembly has the disadvantage of having to clean a multitude of parts but also the reassembly problem.

SUMMARY OF THE INVENTION

The present invention relates to a fluid injector unit which can be easily disassembled into a minimum number of parts to effect cleaning of the parts which come in contact with the fluid during the printing process. Also, the structure of the present fluid injector unit minimizes the number of parts which come in contact with the fluid during printing thereby simplifying cleaning and disassembly. Disassembly of the fluid injector unit of the present invention results by disengaging a unitary assembly from a housing member containing a pump chamber for the fluid to be deposited. The unitary assembly comprises a collar member, a main piston and a biasing means. The collar member has a bore therethrough for slidably engaging the main piston and for guiding and locating the main piston within the pump chamber when the collar is fixedly engaged with the housing member. Although the collar is fixedly engaged with the housing member during the printing process, the means for engagement therebetween are such that the unitary assembly can be easily removed. The unitary assembly also includes a seal means for sealing the lower, outer peripheral face of the main piston with the inner bore of the housing member.

When the unitary assembly is disengaged from the housing member, an auxiliary piston is released from the interior of the pump chamber along with its accompanying biasing means. The auxiliary piston means is slidably engaged in the bore within the interior of the main piston.

The main biasing means for the main piston is external to the fluid passage means and is fixedly connected to the main piston and collar such that the biasing means need not be cleaned or removed from the unitary assembly. Similarly, the seal means is fixedly attached to the main piston such that only a portion of the seal comes in contact with the fluid to be deposited, thereby requiring cleaning. Removal of the unitary assembly leaves the remaining housing member, and auxiliary piston means with its accompanying biasing means easily accessible for cleaning, such as by immersion in a cleaning solvent or solution.

BRIEF DESCRIPTION OF DRAWINGS

Further features of the present invention will be apparent to those skilled in the art to which it relates from the following detailed description of the preferred embodiment thereof made with reference to the accompanying drawings in which:

Referring to FIG. 1, die plate construction 10 which is designed for printing a predetermined pattern is supported from an upper support plate 11 mounted on an upper press platen 12. The press platen 12 cooperates with a lower press platen 13 onto which the sheet or substrate to be printed is placed. In the specification, the material to be printed will be described as a sheet of paper or substrate with the understanding that the invention is applicable to any material to be printed with a design whether or not in sheet form or paper, such as a gasket.

Figure 1:
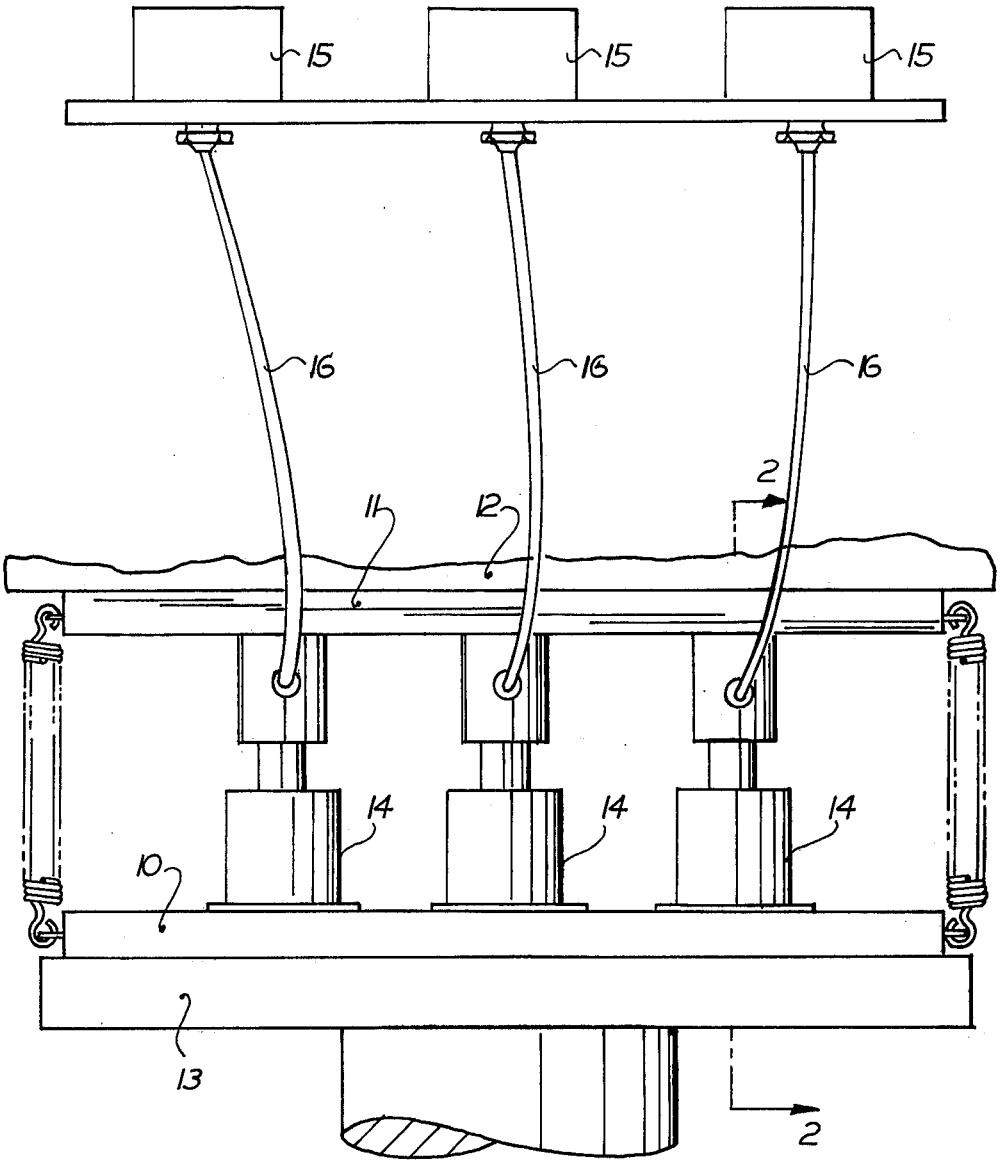
FIG. 1 is an elevational view somewhat schematic of intaglio printing apparatus in accordance with the present invention.

In the apparatus of FIG. 1, paint, or other fluid being deposited, is injected through the die construction 10 by a plurality of fluid injector units 14, three of such units being illustrated in the drawings for printing three different colors. The injector unit illustrated is particularly suitable for simultaneously printing a multitude of colors onto a substrate.

The injector units 14 are each supplied from a corresponding printing fluid reservoir 15. Each injector unit 14 is connected to a corresponding one of the reservoirs 15 by a flexible conduit 16 which conducts printing fluid from the reservoir to the inlet of the injector. While the reservoir 15 may be under pressure, preferably the feed of the reservoirs is a gravity feed. In the type of apparatus such as intaglio printing apparatus to which the present invention relates, the fluid injector units 14 are located between an engraved die plate which is part of the die construction 10 and the upper press platen 12, so that when the press platens 12, 13 are moved toward each other to effect deposition of the fluid, the injector units 14 are contracted to pump fluid into the recesses in the engraved die plate.

The platens are moved toward each other to engage the engraved die plate with a substrate onto which the fluid is to be deposited to establish a pressure and to effect a contraction of the fluid injector units to pump fluid through passages completely through the thickness of the die plate, the fluid flowing into recesses in a lower surface of the die plate for contact with the substrate to be printed. Preferably, the arrangement is such that a sealing pressure is established before the injector units are contracted sufficiently to inject fluid into the recesses in the engraved die plate. The establishment of a sealing pressure causes the seal to be effected between the substrate onto which the predetermined design is to be printed and the edges of the recesses forming a part of the predetermined design. This seal prevents the fluid from flowing out of the recesses in the engraved die plate. Since the contraction of the injector units will cause the fluid to be supplied under pressure, it is important that the injector units supply the proper quantity of fluid under a pressure which is controlled so that the seal between the substrate and the engraved die plate is not broken and so that the fluid will not be splattered onto other areas of the substrate.

Figure 2:
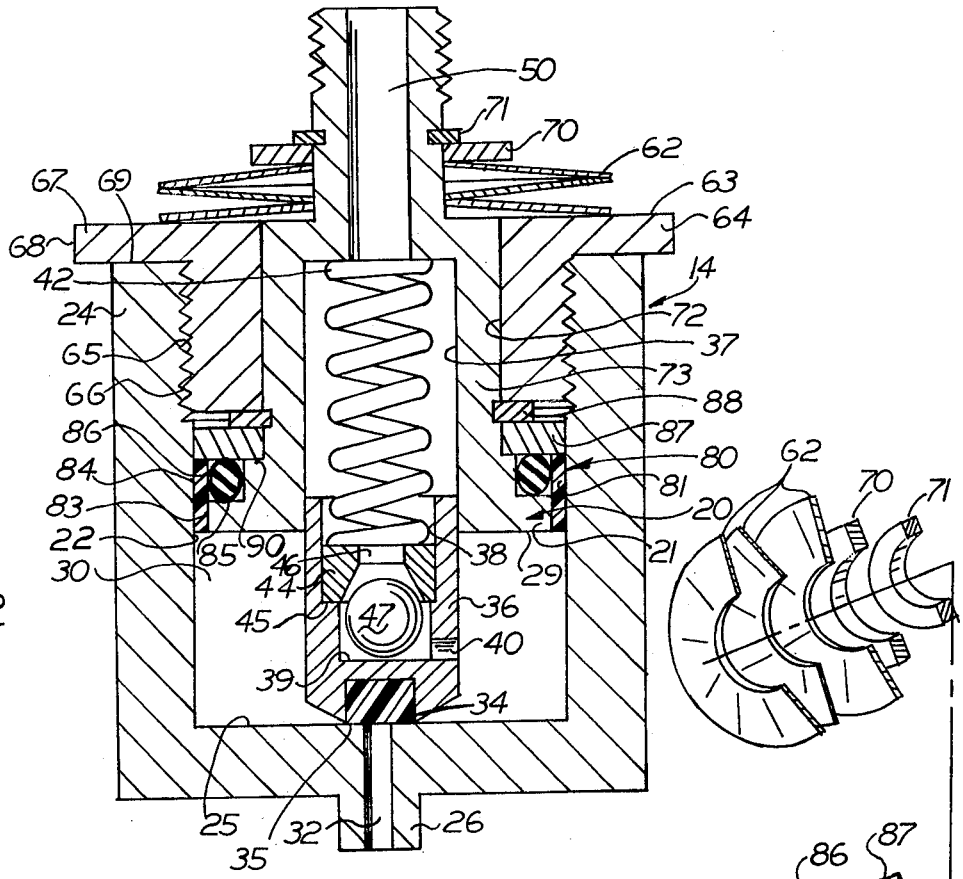
FIG. 2 is a cross-sectional view of a fluid injector unit shown in FIG. 1 taken along line 2—2.
Figure 3:
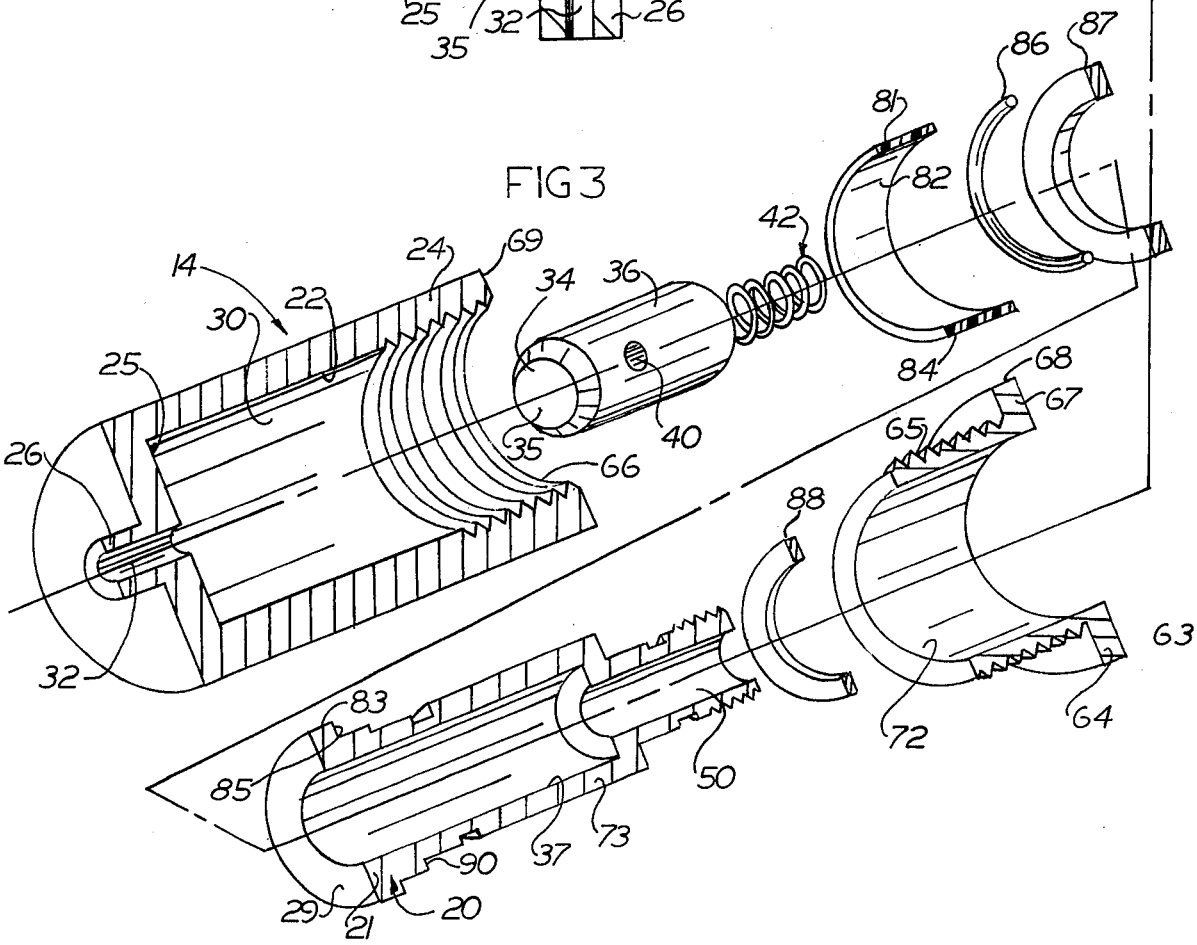
FIG. 3 is an exploded view of the fluid injector unit illustrated in FIG. 2.

The fluid injector unit of the present invention in its preferred embodiment is shown in cross section in FIG. 2. As illustrated therein, an injector unit 14 comprises a piston 20 having a piston head 21 receivable in a bore 22 in a cylindrical housing member 24. The bore 22 opens inwardly from the upper end of the housing member 24 and is closed at the lower end of the housing by a wall 25. The bottom end of the housing member 24 abuts the die construction member 10 and has a cylindrical central pilot portion 26 which is received in an opening in the upper surface of the die construction member 10. Piston head 21 has a piston face 29 which forms a movable wall of a pump chamber 30, the pump chamber 30 contracting in volume as the piston 20 moves inwardly of the housing 24 to pump the printing fluid from the pump chamber 30 through an outlet passage 32 in the bottom of the housing 24. The passageway 32 is coaxial with the pilot portion 26 and opens into an opening in the upper surface of the die construction 10.

The pumping of the printing fluid from the pump chamber 30 is controlled by an outlet valve 34 comprising a pip of resilient rubber-like material which is supported on the end of an auxiliary piston 36 which slides in a bore 37 in the piston 20. The valve 34 has a flat face 35 which seals against the bottom wall 25 of the pump chamber 30. The auxiliary piston 36 which supports the valve 34 has a bore 38, extending downwardly from the top to a bottom wall 39 adjacent the lower end of the auxiliary piston 36. A printing fluid is supplied to the pump chamber 30 through the bore 38 and through a port 40 which extends radially in the auxiliary piston 36 adjacent in the bottom wall 39 of the bore 38 to communicate with the pump chamber 30.

The auxiliary piston member 36 is urged inwardly of the pump chamber 30 by a spring 42 which at one end abuts the end of the bore 37 in the piston 20 and its other end being received in the bore 38 of the auxiliary piston 36 to abut against a valve seat 44. The lower end of the bore 38 in the auxiliary piston 36 is of a reduced cross section to provide a shoulder 45 against which the valve seat 44 abuts and against which it is urged by the spring 42. The valve seat 44 has a central passageway 46 therethrough, the lower end of the passageway having a conical shape which opens downwardly and outwardly and which is adapted to receive a non-return ball check valve 47 disposed in the lower end of the bore 38 between the valve seat 44 and the bottom wall 39 of the bore 38 in the auxiliary piston 36.

Printing fluid is supplied to the bore 38 in the auxiliary piston 36 through an inlet passage comprising a passageway 50 extending outwardly from the bottom of bore 37 in the piston member 20 to the upper end of the piston member 20. The upper end of the piston member 20 is of a reduced cross section and threads into a connector block which is attached to the upper support plate 11 which is, as described above, in turn, connected to the upper press platen 12.

When an injector unit 14 is contracted by relative movement of the press platens 12 and 13 toward each other, the piston head 20 will move downwardly to establish a pressure to close the non-return ball check valve 47. When the valve 47 is closed, the fluid in the pump chamber 30 is trapped and the pressure starts to increase. As the contraction of the fluid injector continues, the pressure increase will be applied to the lower end of the auxiliary piston 36 to cause the valve 34 to be lifted from its seat against the bottom wall 25 of the pump chamber 30 to provide fluid communication to the outlet passageway 32. The lower end of the piston 36 is maintained in a spaced relationship from the bottom wall 25 of the chamber 30 by the valve member 34 and by a taper on its lower end so that the pressure in the chamber will act in an upward manner to move the auxiliary piston 36 outwardly from the pump chamber 30 and open the outlet valve 34.

To assure that there is a part of the piston on which the pressure in the chamber can act upwardly when the valve 34 is in its closed position, the lower end of the auxiliary piston 36 is tapered downwardly and inwardly from its outer edge as illustrated in the drawings to provide an inclined surface which will assure that the lower end of the auxiliary piston cannot fully seat against the bottom wall 25 of the pump chamber 30.

As the contraction of the pump chamber 30 continues, the build up of pressure in the pump 30 chamber is limited by the auxiliary piston 36, thus constituting a pressure relief piston and biasing spring 42. As the pressure builds up, the spring 42 will yield to allow the auxiliary piston 36 further to move outwardly so as to compensate for further contraction of the pump chamber and relieve pressure. Accordingly, the auxiliary piston 36 and spring 42 operate as a pressure limiting element as well as a control valve for the outlet passageway 32.

In operation, the pump chamber preferably does not start to pump fluid until printing pressure between the engraved die plate and the substrate to be printed is established. Accordingly, a stack of Belleville spring washers 62 is placed on an upper surface 63 of piston collar 64 to yieldably resist contraction of the pump chamber 30. The resistance of the washers is preferably such that the proper printing pressure is established before the pressure of the pump chamber 30 builds up sufficiently to close ball check valve 47 and open outlet 34.

When the fluid pressure against the lower end of the auxiliary piston 36 lifts the auxiliary piston to move the valve 34 from its closed position, the fluid will discharge through the outlet passage 32 into an opening in the upper surface of the engraved die plate and through a passage in the die plate into the recesses in the lower surface of the engraved die plate. When the recesses therein are filled, excess pressure will be prevented from building up by reason of a floating action of the auxiliary piston 36.

Piston collar 64 is a generally cylindrical member having external threads 65 for threaded engagement with a correspondingly mating threaded surface 66 on the interior upper surface of housing member 24. The upper portion of piston collar 64 terminates in an annular flange 67 having an outwardly extending shoulder 68, the lower surface of shoulder 68 providing contact with the upper surface 69 of housing member 24. The flange 67 on its outer periphery preferably is provided with flats so as to be engaged by a wrench. The stack of Belleville washers 62 is held in compression against the upper surface 63 of piston collar 64 by washer 70 which rests on the uppermost Belleville washer in the stack of Belleville washers 62 and is held in place by snap ring 71 which fixedly engages a circumferential indentation in the outer periphery of the upper portion of piston 20.

Coaxial bore 72 extends through piston collar 64 for slidable engagement therethrough of an upwardly extending narrowed portion 73 from piston head 21. With this arrangement, the stack of Belleville spring washers 62, forming a connection between piston 20 and piston collar 64, will yieldably resist contraction of pump chamber 30. In addition, piston collar 64 slidably supports piston 20 for movement therethrough and movement in housing member 24.

Sliding and sealing contact between the piston member 20 and the wall of bore 22 is provided by seal 80. The seal 80 comprises a self-lubrication, cylindrical band 81, preferably of polytetrafluoroethylene, having an inner cylindrical surface 82 for contacting and surrounding a lower outer edge 83 of piston head 21 and an outer cylindrical face 84 for slidably contacting the wall of bore 22 of housing member 24. Extending upwardly from the lower, outer cylindrical face 83 of piston head 21 is shoulder 85 for supporting O-ring 86, preferably of a rubber-like material, between sealing band 81 and piston head 21. The diameter of the O-ring 86 is slightly larger than the width of the shoulder 85 in order to bias the sealing band 81 outwardly against the sidewall of the bore 22.

Sealing band 81 and O-ring 86 are held in place at the lower surfaces thereof by the lower outer face 83 of piston 20 and shoulder 85, respectively. The upper surfaces of sealing band 81 and O-ring 86 are contacted by washer 87, which in turn is held in place by snap ring 88. Snap ring 88 engages a circumferential indentation in the outer peripheral surface of the upstanding portion 73 of piston 20. Washer 87 is fixedly engaged with shoulder 90 of piston 20. Thus, by enclosing O-ring 86 within an annular chamber bounded by shoulder 85 and washer 87, sealing band 81 is outwardly biased to bear against the inner wall of bore 22 for proper sealing engagement between the piston 20 and housing member 24.

From the above description of the preferred embodiment of the present invention, it will be seen that the fluid injector unit described herein can be easily disassembled into a minimum number of parts, and it provides sufficient access to the portions of the fluid injector which come in contact with the fluid to be deposited. In this manner, the fluid injector unit of the present invention is more easily and readily cleaned than prior art fluid injector units. Furthermore, the fluid injector unit of the present invention minimizes the number of parts which come in contact with the fluid to be deposited and which would therefore require cleaning when the fluid injector unit is stored or used for another type of fluid.

In order to clean the fluid injector unit of the present invention, the piston collar 64 is threadedly disengaged from housing member 24, releasing a unitary assembly comprising the piston collar 64, the stack of Belleville spring washers 62, the main piston 20, and the accompanying seal 80. When this unitary assembly is removed, O-ring 86 and the stack of Belleville washers 62 remain in place because of snap rings 88 and 71, respectively, thereby minimizing the number of parts which must be disassembled for cleaning. The passage 50 may then be cleaned by flowing a cleaning solution or solvent therethrough without contacting the O-ring 86 or the stack of Belleville washers 62.

When the piston collar 64 is disengaged from the housing member 24, biasing spring 42 and the auxiliary piston 36 are also released from the housing member 24. In this manner, biasing spring 42, auxiliary piston 36, and housing member 24 may be suitably cleaned, such as by immersion in a cleaning solution or solvent without contacting other parts of the fluid injector unit.

What is claimed is:

1. A fluid injector unit for delivering a charge of fluid under pressure onto a substrate comprising a housing having a bore therein defining a fluid chamber and an outlet passage in fluid communication with said fluid chamber, a unitary assembly means including a main piston slidably engagable with the wall of said bore of said housing, a cylindrical collar for releasably engaging said housing, and biasing means interposed between said cylindrical collar and said main piston, said cylindrical collar having an externally threaded surface for threaded engagement with corresponding threads on an upper portion of said bore in said housing, an annular laterally-extending flange at the upper portion of said collar for contact with an upper surface of said housing, and an inner bore within said collar for guiding reciprocal movement therethrough of said main piston, and an auxiliary piston slidably engagable in an inner bore within said main piston and having an inlet valve for permitting flow of fluid into said fluid chamber and an outlet valve for controlling flow of fluid into said outlet passage from said fluid chamber, said unitary assembly means being removable from said housing as a unit without disassembly of said biasing means from said main piston or said cylindrical collar.

2. A fluid injector unit as claimed in claim 1 wherein said main piston is sealed for slidable movement relative to said bore in said housing by a resilient sealing band surrounding the lower outer peripheral face of said main piston and a resilient biasing means for outwardly biasing said sealing band against the wall of said bore in said housing.

3. Apparatus comprising a fluid injector unit as claimed in claim 1 and a plate having a recessed design therein in accordance with a predetermined design to be applied to a substrate, said plate having at least one passage through the thickness of the plate for fluid communication between said recessed design and said outlet passage of said fluid injector.

4. A fluid injector unit as claimed in claim 1 wherein said biasing means comprises a stack of Belleville washers.

5. A fluid injector unit for delivering a charge of fluid under pressure onto a substrate comprising a housing having a bore therein defining a fluid chamber and outlet passage in fluid communication with said fluid chamber, a unitary assembly means including a main piston slidably engagable with the wall of said bore of said housing, a cylindrical collar for releasably engaging said housing, and biasing means interposed between said cylindrical collar and said main piston, said cylindrical collar having external threads for threaded engagement with corresponding threads on an upper portion of said bore in said housing to removably secure said unitary assembly to said housing, and an inner bore within said collar for guiding reciprocal movement therethrough of said main piston, and an auxiliary piston slidably engagable in an inner bore within said main piston and having an inlet valve for permitting flow of fluid into said fluid chamber and an outlet valve for controlling flow of fluid into said outlet passage from said fluid chamber, said unitary assembly means thereby being removable from said housing as a unit while maintaining said biasing means interposed between said main piston and said cylindrical collar.

6. A fluid injector unit as claimed in claim 5 wherein said biasing means comprises a stack of Belleville washers.

7. Apparatus comprising a fluid injector unit as claimed in claim 5 and a plate having a recessed design therein in accordance with a predetermined design to be applied to a substrate, said plate having at least one passage through the thickness of the plate for fluid communication between said recessed design and said outlet passage of said fluid injector unit.

* * * * *